US005603139A

United States Patent [19]

Alazet

[11] Patent Number: 5,603,139

[45] Date of Patent: Feb. 18, 1997

[54] APPARATUS FOR CLEANING BY SPREADING CLEANING LIQUID AND BY SUCTION OF THE USED LIQUID

[75] Inventor: Jean Alazet, Paris, France

[73] Assignee: Famulus, Paris, France

[21] Appl. No.: 365,235

[22] Filed: Dec. 28, 1994

[30] Foreign Application Priority Data

Jan. 14, 1994 [FR] France ..... 94 00348

[51] Int. Cl.[6] ..... A47L 11/03

[52] U.S. Cl. ..... 15/320; 15/344; 15/350; 15/353; 15/365

[58] Field of Search ..... 15/320, 344, 353, 15/321, 365

[56] References Cited

U.S. PATENT DOCUMENTS

| | | | |
|---|---|---|---|
| 2,954,576 | 10/1960 | Helm | 15/320 |
| 3,018,504 | 1/1962 | Hart | 15/320 |
| 3,029,461 | 4/1962 | Osborn | 15/320 |
| 3,040,363 | 6/1962 | Krammes et al. | 15/320 |
| 3,060,484 | 10/1962 | Krammes | 15/320 |
| 3,069,716 | 12/1962 | Smith | 15/365 X |
| 3,491,398 | 1/1970 | Segesman | 15/320 |
| 4,112,538 | 9/1978 | Bates | 15/321 |
| 4,123,818 | 11/1978 | Hurwitz | 15/321 |
| 4,566,149 | 1/1986 | Fitzwater | 15/320 |
| 4,686,735 | 8/1987 | Soeffker et al. | 15/320 |

FOREIGN PATENT DOCUMENTS

| | | |
|---|---|---|
| 31136 | 11/1926 | France . |
| 1526754 | 4/1968 | France . |
| 2420326 | 10/1979 | France . |
| 2424218 | 11/1975 | Germany . |

*Primary Examiner*—Chris K. Moore
*Attorney, Agent, or Firm*—Young & Thompson

[57] ABSTRACT

A manual apparatus for cleaning by spreading cleaning liquid and for sucking up the used liquid, comprises a cleaning head (2) provided with a supply orifice for cleaning liquid, structure (11) for spreading the liquid over the surface to be cleaned, and a squeegee (5) provided with at least one suction opening (8) for the used liquid. A used liquid reservoir (19–20), as well as a cleaning liquid reservoir (25); and channels (9, 12) connect the used liquid reservoir to the suction opening (8) carried by the cleaning head (2) on the one hand and the cleaning liquid reservoir to the supply opening of the cleaning head (2) on the other hand. A suction device (33) is provided, as well as controls (39) for the supply of cleaning liquid and for the suction (37) of used liquid. There is also provided a gripping handle (4).

8 Claims, 4 Drawing Sheets

APPARATUS FOR CLEANING BY SPREADING CLEANING LIQUID AND BY SUCTION OF THE USED LIQUID

FIELD OF THE INVENTION

The invention relates to an apparatus for cleaning by spreading cleaning liquid and by suction of the used liquid.

BACKGROUND OF THE INVENTION

The document EP 0 422 977 A1 of the same inventor describes a suction apparatus with a scraper or squeegee for the elimination of dirty water during cleaning of certain surfaces. The scraper comprises, according to a particular modified embodiment, a stepped cutout along one of the edges of its working end and comprises at least one suction channel provided within the portion of the body of this scraper which is situated in vertical alignment with this stepped cutout.

The known apparatus comprises according to a particular modified embodiment a reservoir of cleaning liquid supplying by a series of small channels a spreading member such as a brush, and a reservoir for dirty cleaning liquid adapted to collect the dirty cleaning liquid after suction by a roller pump.

The assembly of the mentioned elements is mounted within a casing comprising a sleeve adapted to receive a manipulating sleeve or gripping handle.

This known device is generally satisfactory for intensive use, but is poorly adapted for household use for the following reasons: the casing integrating a roller pump and its drive motor, the two reservoirs and the necessary connecting conduits is of heavy weight, which renders the holding or displacement on the surfaces having contours such as staircases, relatively difficult; moreover, because most of the weight of the apparatus is in frictional contact on the substratum, the force to move it to be applied to the sleeve is high.

The document DE 24 24 218 A1 describes a cleaning apparatus for windows, facades, decks or the like, comprising a working head disposed at the end of a hollow sleeve, said working head comprising means for supplying the liquid itself, means for distribution of said liquid on the surface to be cleaned and a cleaning scraper. A tubular chamber in the form of a hollow sleeve contains a reservoir of cleaning liquid connected to said supply means for cleaning liquid.

This apparatus generally gives satisfaction, but requires periodically wringing out an absorption sponge for the liquid in a receptacle that receives it.

SUMMARY OF THE INVENTION

The invention has for its object to overcome the drawbacks of the prior art, by providing a new portable cleaning apparatus, for easy utilization and low cost manufacture.

The invention has for its object an apparatus for cleaning boards, floors, tiles, walls or such smooth surfaces by distributing cleaning liquid and by suction of used liquid, of the type comprising in combination: a working head or cleaning member comprising means for supplying cleaning liquid; means for distributing said liquid on the surface to be cleaned and a cleaning squeegee; a tubular chamber in the form of a hollow sleeve containing a reservoir of cleaning liquid connected to said supply means for cleaning liquid, and a gripping handle; characterized in that the apparatus comprises also a reservoir for used liquid contained at least partially in said tubular chamber, as well as means for placing under vacuum said reservoir of used liquid, so as to draw the used liquid through a vacuum orifice for used liquid provided on the squeegee and a suction pipe for used liquid.

According to other characteristics of the invention:

- the reservoir for used liquid is constituted by a sealing assembly of the working head or cleaning member and the interior of the lower portion of the tubular chamber,
- the reservoir of used liquid is of one-piece construction (FIG. 5) and comprises a passage opening for a suction pipe for the used liquid,
- the reservoir for used liquid has a T-shape and comprises at its base a transverse extension provided with an emptying plug,
- the end of the suction pipe by which the used liquid empties into the reservoir of used liquid, and the end of the suction tube for air by which said reservoir is placed under vacuum, are disposed substantially on the same axis and spaced apart axially, so as to avoid any suction of used liquid through the suction tube for air,
- the cleaning liquid reservoir is closed by a gripping handle,
- the gripping handle carries the means for placing under vacuum the used liquid reservoir,
- the gripping handle is disposed at the upper end of the cleaning liquid reservoir, while the means for placing under vacuum are disposed between the cleaning liquid reservoir and the used liquid reservoir,
- a transverse partition is provided between the tube for placing under vacuum the used liquid reservoir and the suction pipe of the used liquid reservoir, so as to constitute a deflecting cap preventing the used liquid from being drawn into the tube for placing under vacuum,
- the suction tube and the tube for placing under vacuum the used liquid reservoir house a removable cleaning brush which serves as a filter against large impurities.

According to a first embodiment of the invention, the tubular chamber comprises two superposed compartments sealed from each other, a lower compartment forming the used liquid reservoir, an upper compartment forming the cleaning liquid reservoir, the air suction tubing passing axially through the cleaning liquid reservoir and being connected to the exterior of this latter by the vacuum means carried by the gripping handle.

According to a second embodiment of the invention, the tubular chamber comprises three compartments: a lower compartment constituting the used liquid reservoir, an intermediate compartment constituting the housing for the suction means and an upper compartment constituting the cleaning liquid reservoir, the gripping handle being removably mounted so as to constitute the plug for the refilling opening of the cleaning liquid reservoir.

BRIEF DESCRIPTION OF THE DRAWINGS

The invention will be better understood from the description which follows given by way of non-limiting example with respect to the accompanying drawings, in which.

DETAILED DESCRIPTION OF THE INVENTION

Figure 1:
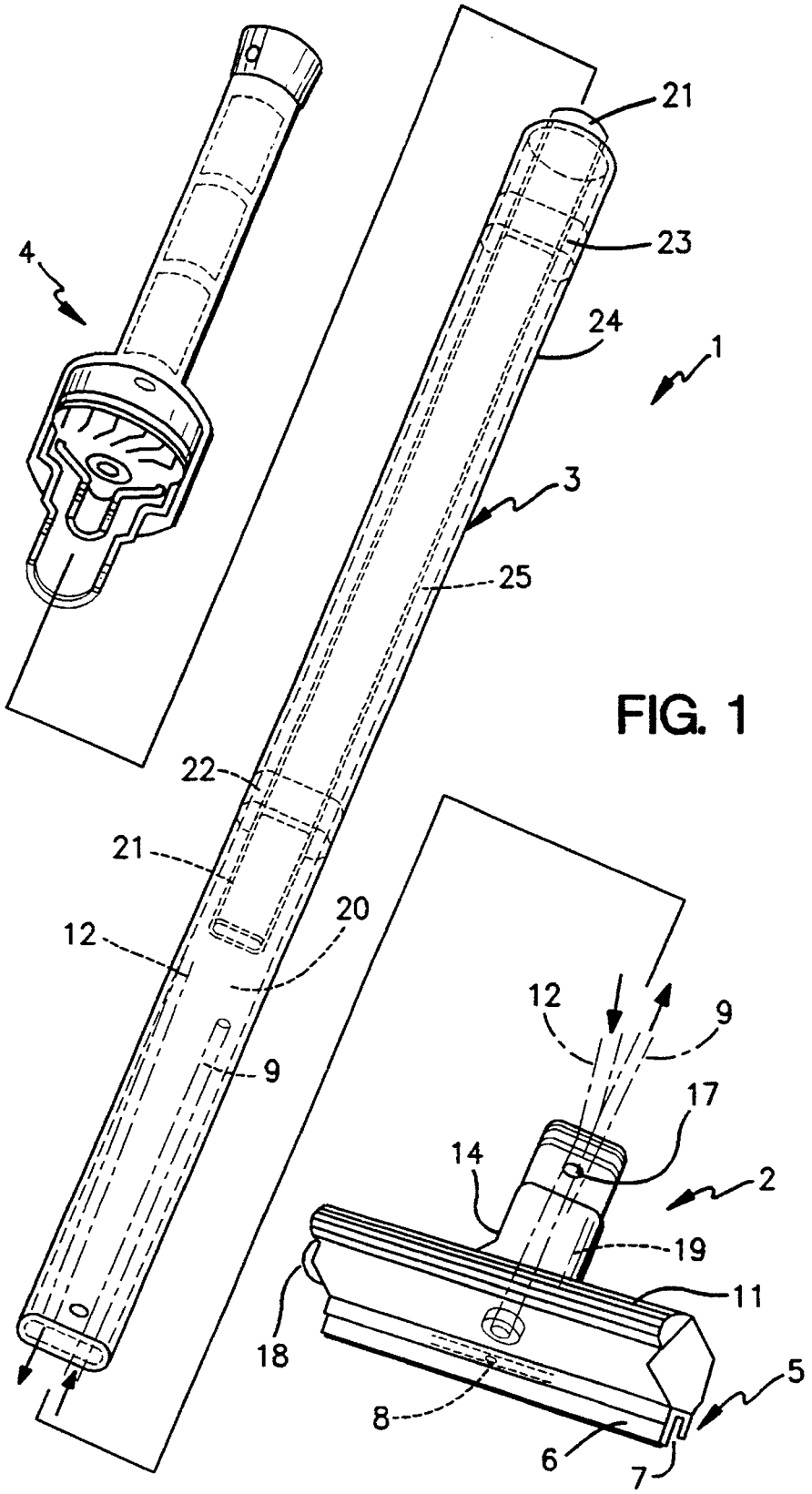
FIG. 1 shows schematically an exploded perspective view of a first embodiment of the apparatus according to the invention.
Figure 2:
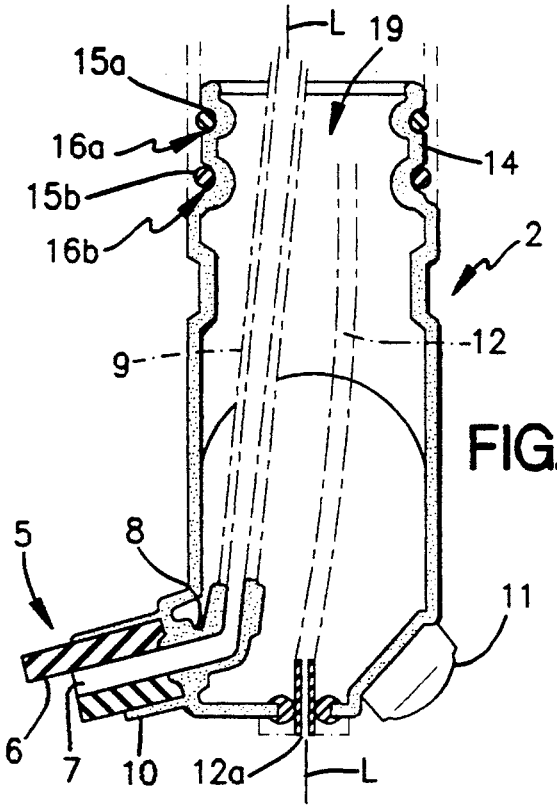
FIG. 2 shows schematically a view in transverse cross section of a cleaning member of the apparatus according to FIG. 1.
Figure 3:
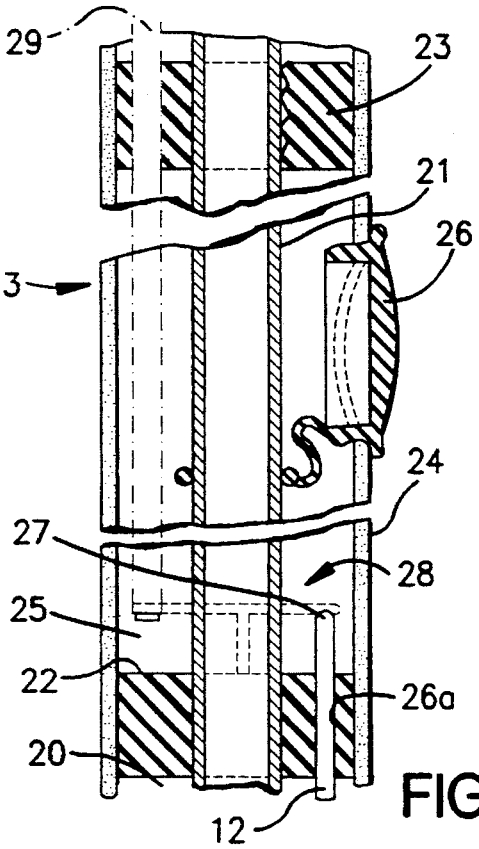
FIG. 3 shows schematically in transverse cross section a central portion of the apparatus according to FIG. 1.
Figure 4:
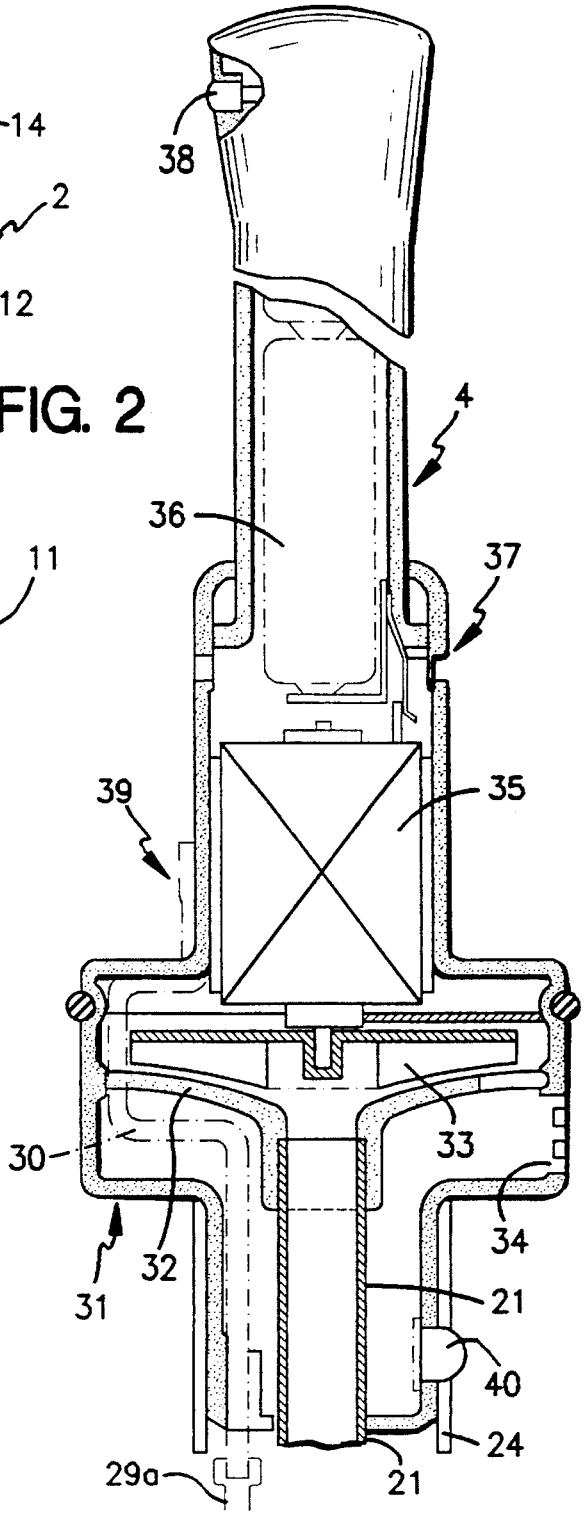
FIG. 4 shows schematically in transverse cross section a head of the apparatus according to FIG. 1.

Referring to FIGS. 1 to 4, an apparatus according to the invention designated generally by reference numeral 1 is adapted in particular for cleaning large smooth surfaces, such as floors or tiles.

The apparatus 1 comprises a cleaning member 2, a central portion 3 and a handle 4 insertable sequentially in a sealed manner one within the other by means of appropriate shapes and sealed joints.

The cleaning member 2 comprises a monobloc squeegee 5 of elastomer, rubber or like material. The squeegee 5 has a stepped configuration 6 and at least one central channel 7 communicating through a ferrule 8 with a suction pipe 9 of the used liquid spread on the floor.

The cleaning member 2 has preferably a recess 10 for reception of the squeegee 5 so as to facilitate its replacement.

It is preferable to provide for mounting at a substantially symmetrical inclination relative to a medial longitudinal plane L of the cleaning member 2, a removable spreading member 11, of the type of a brush, a porous strip, a sponge strip or the like. The spreading member 11 is used to spread evenly the liquid itself flowing through at least one central channel 12 for supply of the liquid itself opening substantially in the medial longitudinal plane L through an orifice 12*a*.

The cleaning member 2 has substantially a T shape, whose leg 14 corresponds to a housing conduit sealed with the lower portion of the central portion 3.

The sealing is ensured by O-rings 15*a*, 15*b* disposed in grooves 16*a*, 16*b* and the locking is ensured by a click button 17 retractable upon simple pressure from a finger.

The cleaning member 2 is hollow and comprises a plug 18 for emptying the used liquid, such that after sealed assembly of the cleaning member 2 to the central portion 3, the interior 19 of the cleaning member forms with the interior 20 of the base of the central portion 3 a suction reservoir for used liquid.

The reservoir 19–20 thus formed receives the used liquid through the pipe 9 emptying thereinto, the suction resulting from a vacuum created by the tubing 21 for applying suction secured to the central portion 3 of the apparatus.

The central portion 3 comprises two annular sealing plugs 22 and 23 disposed between the external tubular wall 24, of rectangular section with rounded, elliptical or other edges, and the mentioned suction tubing 21.

The plugs 22, 23 delimit between themselves a reservoir 25 for cleaning liquid adapted to be supplied through a filling plug 26. The reservoir 25 integrated into the central portion 3 in the form of a sleeve is separated from the reservoir 20 by a plug 22 permanently fixed for example by cementing, thermowelding or an analogous process and communicates with the supply conduit 12 for cleaning liquid via a channel 26*a* passing through the plug 22 and communicating with the channel 12 for supply of cleaning liquid itself.

It is provided for this purpose that the corresponding shapes of the channel 26*a* and of the channel 12 ensure sealed snapping together of these channels with each other, during assembly of the central portion 3 with the cleaning member 2.

A plug 27 mounted on an elastic system 28 controllable by a rod 29 or analogous mechanical means for remote control, closes the upper end of the channel 26*a*.

The control 29 acts by bearing on the end of an elastic shape 28 in the form of a cantilever which, in rest position, closes the inlet of the channel 26*a*, and, in its position downwardly pushed by the rod 29, raises the plug 27 and supplies the channel 26*a*.

The rod 29 mounted slidably in the central portion 3 and passing through the upper plug 23 has an upper end 29*a* encasing and coacting with a manipulating member 30 slidably retained in the head 4 of the apparatus according to the invention.

The head 4 has an enlarged shape constituting a housing 21 in which is mounted a flared portion 32 forming a body for a suction fan 33 adapted to create a suction through the tubing 21 within the reservoir 20 for the suction of used liquid and to expel the aspirated air toward the exterior through suitable orifices 34.

The fan 33 is driven in rotation by a small electric motor 35 disposed coaxially above the fan 33; the electric motor 35 is supplied by a set of batteries 36 in series with a supply switch 37 and rechargeable by means of a coaxial connector 38.

The actuation of the manipulating member 30 is effected by means of a sliding button 39, while the mechanical securement of the head 4 on the central portion 3 results from the snapping of the pushbutton 40 into a corresponding opening of the wall 24 of the central portion.

This working arrangement thus permits the separation of the apparatus according to the invention into three separately replaceable modules:

- the first module 2 or a cleaning member comprises all the pieces subject to wear such as the squeegee 5, the spreading member 11, in contact with the surfaces to be cleaned,
- the second module 3 or central portion serves as a reservoir for the liquid itself and as a receptacle for dirty liquid and has a size corresponding to that of the sleeves of the apparatus of the prior art,
- the third module 4 or head serves as a handle and combines all the control and energy source means: a source of vacuum, control of the cleaning liquid supply, electric motor and batteries.

It will be seen in this first embodiment that, in the mounted condition, the apparatus comprises an essentially tubular chamber comprising two superposed compartments sealed from each other, namely the used liquid reservoir 19–20 in immediate contact with the cleaning head 5, and the cleaning liquid reservoir 25 traversed by the air suction tube 21, this latter being connected at its upper part to the suction means 32–36 carried by the gripping handle 4. It will also be seen that the used liquid reservoir 19–20, the facing ends of the used liquid suction pipe 9 and the air suction tube 21 are disposed along substantially the same vertical axis and are axially spaced apart. This ensures that the liquid drawn through the pipe 9 will not be in danger of passing into the tube 21. Moreover, the height of the pipe 9 within the reservoir 19–20 is sufficient to give to the apparatus a storage capacity corresponding to the surface of the area to be cleaned.

If the used liquid exceeds the upper level of the pipe 9, this latter will serve as an overflow warning the user that he must empty the reservoir 19–20.

FIGS. 5 to 10 show a second embodiment of the invention. The parts having the same functions as in the preceding example have the same reference numerals.

According to this second embodiment, the tubular chamber of the apparatus 1 is divided in three vertically stacked compartments: the lower compartment comprising the used liquid reservoir 19–20, the intermediate compartment 41 constituting the housing for the suction means and the upper compartment constituting the cleaning liquid reservoir 25.

Figure 6:
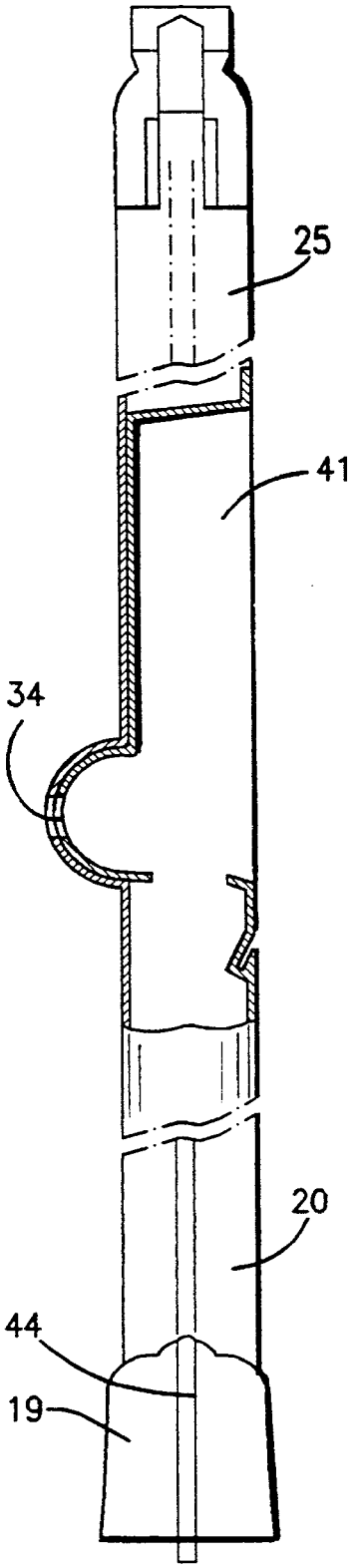
FIG. 6 shows schematically a transverse cross-sectional view of the cleaning member of the apparatus according to FIG. 5.

In the illustrated example, this assembly is formed from a single piece by blow molding plastic, the intermediate compartment being obtained by sinking and bringing toward each other the two walls of the chamber as seen in particular in FIG. 6.

However, these three compartments could as a modification be formed of separate nestable elements in a sealed manner, analogously to the example of the preceding embodiment.

As in the preceding embodiment, the used liquid reservoir comprises at its base a transverse extension 19 provided with an emptying plug 18, so as to give to the apparatus the overall appearance of a conventional household sweeper.

However, this configuration is not essential and the transverse extension could well be omitted, the apparatus then being of uniform cross-sectional configuration from practically the base of its handle to the end of the used liquid reservoir.

Figure 7:
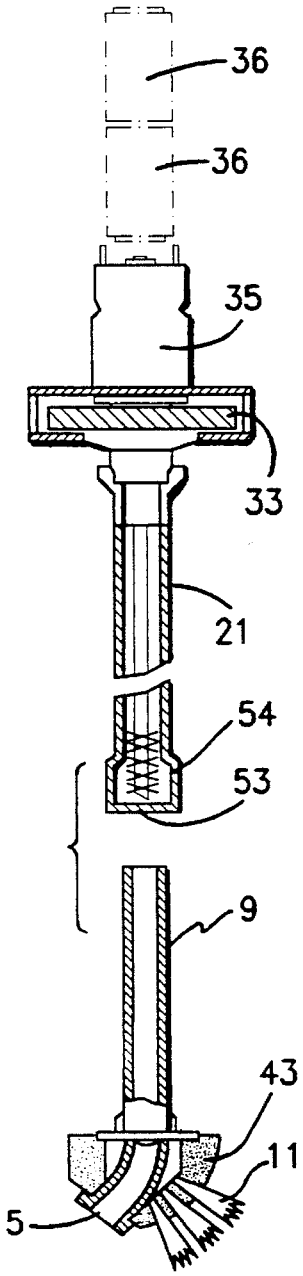
FIG. 7 shows schematically in longitudinal cross section in their operative position the suction pipe for used water, the suction pipe for air and the vacuum means of the apparatus of FIGS. 5 and 6.

The rear of the extension 19 comprises a medial opening for the passage of the suction pipe 9 and, of the same material, two ears 42 for snapping into a cleaning head 43 which carries the squeegee 5 and the spreading means for the cleaning liquid shown here in the form of brush bristles 11 (FIG. 7).

On the lateral sides of the apparatus are disposed, of the same material, two external conduits 44, 45 diametrically opposed relative to the medial vertical axis of the apparatus. The conduit 44 is adapted to supply cleaning liquid by gravity from the reservoir 25 to the supply orifice 45 at the lower end of the reservoir 19. To this end, substantially at the level of the base of the reservoir 25, there is provided a direct communication (not shown) between the reservoir 25 and the conduit 44. Within the conduit 44 there extends moreover a flexible cable 47 which extends over all the height of the apparatus and whose lower end is provided with a conical plug 48 (FIG. 9) coacting with the orifice 46. The upper end of the flexible cable 49 opens above the reservoir 25 in the chamber provided between the external wall of the apparatus and the filling neck 50 of the reservoir 25 in which it is mounted by means of a return spring to maintain the plug 48 in the position to close the orifice 46. In operation, the opening movement of the orifice 46 will be controlled by the sliding of the button 30 (FIG. 5) which forms the sliding closure cap of a surface of the apparatus at the level of the handle 4. To permit the passage of the end 49 of the cable 44 to within its chamber, an opening (not shown) is provided in the conduit 44 at the level of this chamber.

The conduit 45 diametrically opposed to the conduit 44 is also provided with a flexible cable 51 which enters into the intermediate compartment 41 to actuate the electric switch of the motor 35. In a manner analogous to cable 46, the cable 51 is mounted at its upper end by return spring means and manipulated by a button 30 symmetrical to the preceding one.

It will be understood that the conduit 45 could be interrupted below the switch 37. In the illustrated example, it is however prolonged to the lower end of the apparatus for reasons of esthetic balance.

The intermediate compartment 41 housing the motor 35, the rotary fan 33 and the batteries 36 is closed by a removable cap 51 provided with outlet holes 34 for air sucked by the rotary fan 33. The compartment 31 also comprises holes 34 symmetrical to those of the cap 52.

Although in the preceding embodiment, the interior of the used liquid reservoir 19–20, the tubing 21 and the pipe 9 were disposed with a slight offset between their vertical axes of symmetry, in the present example they are aligned on the same axis. As in the preceding examples, the facing ends of the pipe 9 and of the tubing are separated axially by a space permitting the used liquid to fall back into the reservoir 19–20, along the pipe 9 without risk of penetrating the tubing 21.

According to a modification shown in this second embodiment, but which is applicable also to the preceding embodiment, the end of the tubing 21 facing the pipe 9 is covered with a transverse partition 53 connected to the tubing by two tongues.

The partition 53 is of a larger section than that of the tubing so as to constitute a deflector covering which prevents the liquid from penetrating into the tubing in the case in which the user raises the apparatus for example when he wishes to change the squeegee 5 or the brush 11.

As a modification, this arrangement could be effected by a partition closing the end of the tubing 21, the radial openings being provided in said tubing in immediate proximity to the partition.

According to a particularly advantageous modification, the tubing 21 houses a brush 54 whose bristles are visible in the end openings of the tubing, the sleeve of this brush being oriented toward the rotary fan 33.

This brush 54 has two functions. On the one hand, when it is housed in the tubing 21, it prevents large impurities from being drawn in by the suction (for example, cigarette butts or the like) so that they cannot enter the tubing 21.

On the other hand, when the brush is withdrawn from the tubing, it serves to clean the pipe 9 which must be completely clean and smooth so that possible deposits will not constitute obstacles to the sucking in of the used water.

To permit access to the brush 54, there is provided in this embodiment the mounting of the assembly of the motor 35 and rotary fan 33 removably in its intermediate compartment 41. If it is desired to apply this modification to the preceding embodiment, it suffices to provide that the partition 53 will be mounted removably at the end of the tubing 21.

Figure 5:
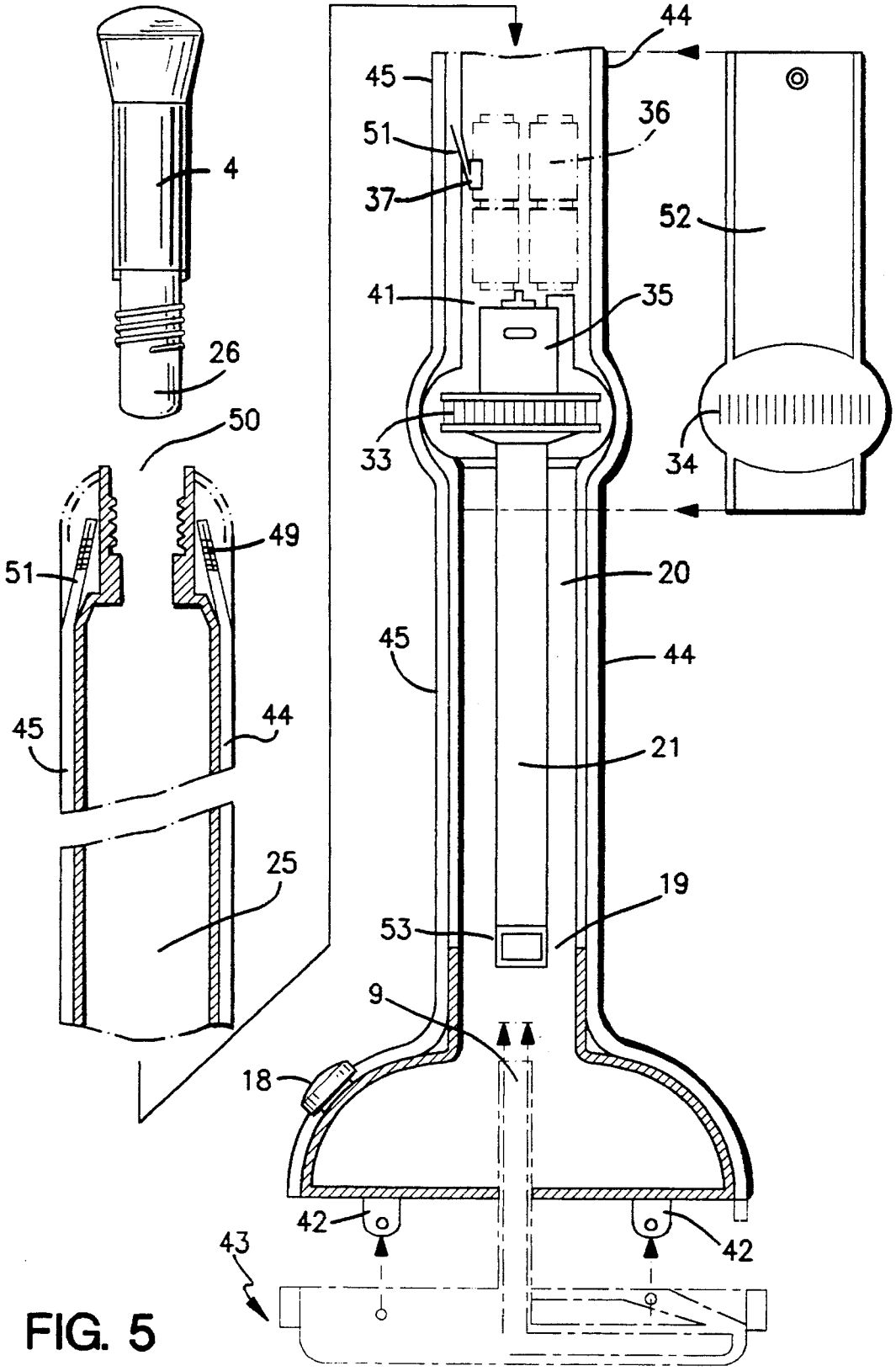
FIG. 5 shows schematically in an exploded view from above a second embodiment of the invention.
Figure 8:
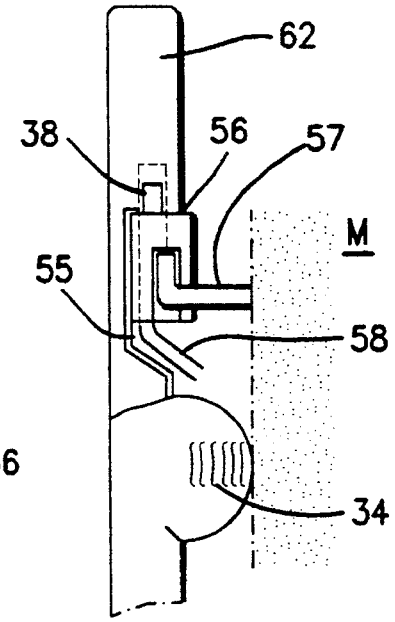
FIG. 8 shows schematically a longitudinal cross-sectional view of the recharging means for the electrical batteries of the apparatus of FIGS. 5 to 7.
Figure 9:
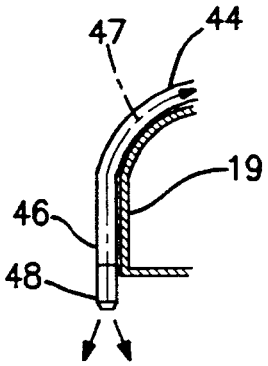
FIG. 9 shows schematically a detailed view in an enlarged cross section of the closure means of the supply channel of the cleaning liquid for the apparatus of FIGS. 5 to 8.
Figure 10:
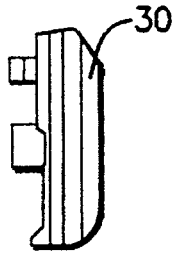
FIG. 10 shows schematically a side view of the pushbutton shown in FIG. 5.

FIG. 8 shows the means for recharging the batteries of the apparatus in the embodiment of FIG. 5. To this end, there is provided in the wall of the cover 52 a recess 55 provided with a coaxial connector 38. This recess permits the assembly of the apparatus to be adaptable to a mounting 56 secured to the wall M by a hook 57 and connected to the electric circuit by the supply cord 58. The socket (not shown) will then be provided with the usual transformer.

I claim:

1. Apparatus for cleaning smooth surfaces by spreading cleaning liquid and by sucking up used liquid, comprising in combination: an upper gripping handle; a lower working head comprising supply means for supplying cleaning liquid, means for distributing said cleaning liquid from said supply means over the surface to be cleaned and a cleaning squeegee having an aspiration orifice; and a tubular chamber connected to and intermediate of the gripping handle and the working head, said tubular chamber being in the form of a hollow sleeve containing a first reservoir for storing cleaning liquid, said first reservoir having an open top which is closed by said gripping handle, and being fluidly connected to said supply means, a second reservoir for storing used liquid, said second reservoir being disposed at least partially in said tubular chamber, and being fluidly connected to the aspiration orifice via a suction pipe, and means for placing under vacuum said second reservoir so as to draw the used liquid through the aspiration orifice and through the suction pipe.

2. Apparatus according to claim 1, wherein the second reservoir is constituted by a sealed assembly of the working head and of the interior of a lower part of the tubular chamber.

3. Apparatus according to claim 1, wherein the second reservoir has a T-shape and comprises at its base a transverse extension provided with an emptying plug.

4. Apparatus according to claim 1, wherein the means for placing said second reservoir under vacuum includes an air suction tubing, and facing ends of the suction pipe and of the air suction tubing are disposed substantially on the same axis and spaced apart from each other axially, so as to avoid any aspiration of used liquid through the air suction tubing.

5. Apparatus according to claim 4, further including a transverse partition located between the air suction tubing and the suction pipe, said partition preventing the used liquid from being sucked into the air suction tubing.

6. Apparatus according to claim 5, wherein the air suction tubing houses a filtering brush for retaining dust.

7. Apparatus according to claim 1, wherein the gripping handle carries the means for placing under vacuum the used liquid reservoir.

8. Apparatus according to claim 1, wherein the gripping handle is disposed at the upper end of the first reservoir, while the means for placing under vacuum are disposed between the first reservoir and the second reservoir.

* * * * *